US006231489B1

(12) United States Patent
McBride et al.

(10) Patent No.: US 6,231,489 B1
(45) Date of Patent: May 15, 2001

(54) DEVICE FOR MULTIPLE TORSO EXERCISES

(75) Inventors: Robert W. McBride, Springfield, MO (US); Newton Lin, Taiwan (TW); Marjolein Brugman, Santa Fe, NM (US)

(73) Assignee: Stamina Products, Inc., Springfield, PA (US)

( * ) Notice: Subject to any disclaimer, the term of this patent is extended or adjusted under 35 U.S.C. 154(b) by 0 days.

(21) Appl. No.: 09/317,193

(22) Filed: May 24, 1999

(51) Int. Cl.[7] ..... A63B 26/00
(52) U.S. Cl. ..... 482/142; 482/132; 482/907
(58) Field of Search ..... 482/142, 140, 482/144, 145, 4, 907, 1, 96, 130, 133; 606/240–242; 601/23–25, 128, 123

(56) References Cited

U.S. PATENT DOCUMENTS

| | | | | |
|---|---|---|---|---|
| 1,836,981 | * | 12/1931 | Matheson | 601/23 |
| 2,123,765 | | 7/1938 | Broberg . | |
| 2,738,975 | * | 3/1956 | Zaboy | 482/144 |
| 3,769,969 | * | 11/1973 | Nezik | 482/142 |
| 3,835,844 | | 9/1974 | Lang . | |
| 4,066,259 | | 1/1978 | Brentham . | |
| 4,302,005 | | 11/1981 | Silbernan . | |
| 4,634,119 | * | 1/1987 | Pesthy | 482/142 |
| 4,768,779 | | 9/1988 | Oehman, Jr. et al. . | |
| 4,867,142 | * | 9/1989 | Jones | 602/32 |
| 5,147,259 | | 9/1992 | Hutchins . | |
| 5,190,513 | * | 3/1993 | Habing et al. | 482/145 |
| 5,324,247 | | 6/1994 | Lepley . | |
| 5,336,152 | | 8/1994 | Winslow et al. . | |
| 5,393,286 | | 2/1995 | Cheng . | |
| 5,393,287 | * | 2/1995 | Papapaschalis | 482/142 |
| 5,466,205 | * | 11/1995 | McLane et al. | 482/140 |
| 5,573,485 | | 11/1996 | Geschwender . | |
| 5,634,887 | | 6/1997 | Fortier . | |
| 5,669,865 | * | 9/1997 | Gordon | 482/142 |
| 5,718,660 | * | 2/1998 | Chen | 482/144 |
| 5,772,614 | * | 6/1998 | Lindquist | 601/116 |
| 5,795,276 | | 8/1998 | Almeda . | |
| 5,830,114 | * | 11/1998 | Halfen et al. | 482/70 |
| 5,906,564 | * | 5/1999 | Jacobsen | 482/96 |
| 6,030,324 | * | 2/2000 | McBride | 482/142 |

FOREIGN PATENT DOCUMENTS

| | | | | |
|---|---|---|---|---|
| 3632124 | * | 4/1988 | (DE) | 482/143 |

* cited by examiner

*Primary Examiner*—Justine R. Yu
(74) *Attorney, Agent, or Firm*—Pillsbury Winthrop LLP

(57) ABSTRACT

An exercise device comprising a frame structure constructed and arranged to be supported in an operative position on a horizontal surface so as to extend longitudinally therealong. An exercise support is fixedly mounted on one longitudinal end of the frame structure in a position spaced above the horizontal surface when the frame structure is supported thereon in an operative position. The exercise support is constructed and arranged to enable a user to engage the user's feet with the exercise support or grip the user's hands on the exercise support. A seat is carried on the one end portion of the frame structure in longitudinally spaced relation with respect to the exercise support. A plurality of rollers made of yieldable material is rotatably supported on the frame structure in an upwardly arched array extending longitudinally upwardly from the seat and arching downwardly toward an opposite longitudinal end of the frame structure to rollingly support a user thereon. The seat has a downwardly inclined position enabling a user to accomplish back decompression, lower back or side stretches while supported supine, prone or on a side respectively on the seat and the rollers with the user's feet engaging with the exercise support or to accomplish lower back strengthening exercises while supported prone on the seat and rollers with the user's hands gripping the exercise support with outstretched arms.

35 Claims, 7 Drawing Sheets

DEVICE FOR MULTIPLE TORSO EXERCISES

FIELD OF THE INVENTION

The present invention relates to exercise equipment and more particularly to an exercise device for stretching and strengthening spinal muscles and ligaments and related muscle groups.

BACKGROUND OF THE INVENTION

The spine is made up of twenty four vertebrae that are separated by discs and held together by muscles and ligaments. The discs are soft elastic structures primarily made of cartilage. Discs act as shock absorbing cushions between the vertebrae. The spinal cord runs through a hole in each vertebra of the spine and these holes are collectively referred to as the spinal canal. Some of the nerves of the spinal cord extend outwardly therefrom, passing between the vertebrae and traveling to the arms, shoulders, torso and legs. Most back pain is due to pressure on a disc and/or irritation of the ligaments and muscles around the disc. Pressure on a disc can result in pressure on a nerve or nerves of the spine which can also cause back pain.

Individuals with poor posture and/or weak back muscles and ligaments frequently place excessive pressure on the discs and nerves and related soft tissues of the back. This pressure or compressive force on the discs, nerves and other soft tissues of the spine can result in back pain and damage to the discs, but can be alleviated or prevented entirely by proper stretching of the spine and by increasing the strength and flexibility of the muscles and ligaments that hold the vertebrae in place.

Because the spine is flexible and capable of bending forwardly, rearwardly and from side to side, a complete exercise program for the spine and back should incorporate all four of these movements. More specifically, the spine should be stretched in these four directions to increase flexibility and to strengthen and condition the ligaments and other connective tissues which hold the vertebrae together and the spine should be strength by moving the spine in these four directions against a resistance or opposing force. Bending the spine rearwardly a proper degree is especially valuable for relieving pressure on the discs. The ideal exercise equipment for stretching and strengthening the spine should facilitate these movements. A back conditioning and strengthening exercise device should also help the user strengthen and related muscle groups such as the neck muscles, abdominal muscles, arms muscles and legs muscles.

Exercise equipment heretofore has not provided a complete exercise program for the spine. Examples of exercise equipment can be found in U.S. Pat. Nos. 5,573,485; 5,634,887; 5,324,247; and 5,795,276, but none of the devices disclosed in these patent references provides stretching and strengthening of the back and spinal muscles in all four spinal directions or complete strengthening and conditioning of related muscle groups.

A need exists for an exercise device that can provide a user with a complete exercise routine for stretching and strengthening the spinal muscles and related muscle groups and disc decompression.

SUMMARY OF THE INVENTION

To meet the need expressed above, the invention provides an exercise device comprising a frame structure constructed and arranged to be supported in an operative position on a horizontal surface so as to extend longitudinally therealong. An exercise support is fixedly mounted on one longitudinal end of the frame structure in a position spaced above the horizontal surface when the frame structure is supported thereon in an operative position. A seat is carried on the one end portion of the frame structure in longitudinally spaced relation with respect to the exercise support. A plurality of rollers made of yieldable material are rotatably supported on the frame structure in an upwardly arched array. The upwardly arched array extends longitudinally upwardly from the seat and the arches downwardly toward an opposite longitudinal end of the frame structure to rollingly support a user thereon.

The exercise support is constructed and arranged to enable a user to engage his feet with the exercise support or to grip his hands on the exercise support. The seat has a downwardly inclined position enabling a user to accomplish back decompression, lower back or side stretches while supported supine, prone or on a side, respectively, on the seat and the rollers with the user's feet engaging the exercise support or to accomplish lower back strengthening exercises while supported prone on the seat and rollers with the user's hands gripping the exercise support with outstretched arms.

The seat is releasably retainable on the frame structure in a range of positions including the downwardly inclined position and a level position wherein the seat extends generally horizontally. When the seat is in its level position, the user can accomplish lower back strengthening exercises by supporting his chest on the seat and holding onto the exercise support with outstretched arms to permit his legs to be moved in the air.

The frame structure supports a pair of laterally spaced opposite end hand grips disposed in a position to enable a user to accomplish lumbar stretches wherein the user supports his torso above the rollers by engaging his knees on the seat in its level position and by holding onto the opposite end hand grips with outstretched arms.

The range of positions of the seat also includes an upwardly inclined position wherein the seat inclines upwardly with respect to the level seat position. The upwardly inclined seat position enables the user to accomplish lower back or abdominal stretches wherein the user is supported on the seat and on the adjacent rollers in a generally seated position with his feet in the air or supported by the exercise support, respectively.

The frame structure supports laterally spaced seat adjacent hand grips carried by the frame structure adjacent the seat in a position enabling a user seated on the seat and on the rollers adjacent the seat with the seat in its upwardly inclined position and while facing away from the exercise support, to reach down and grip the seat adjacent hand grips to hold his body position while he moves his legs in the air.

The frame structure supports laterally spaced intermediate hand grips carried by an intermediate portion of the frame structure in an upper back strengthening position. The intermediate hand grips enable a user positioned with his back engaging the rollers, his head and shoulders on a floor pad extending from the opposite end of the frame structure and his legs extending upwardly in the air, to reach down below the rollers that are supporting his back and grip the intermediate hand grips conveniently with both hands. This allows the user to retain his head, shoulders and back in the upper back strengthening position while he moves his legs in the air.

The exercise support is in releasably locked engagement with the frame structure to allow the exercise support to be released from locking engagement therewith and moved with respect thereto in a generally longitudinal direction and then relocked to accommodate the arm length and leg length of the user.

The exercise device can be easily moved by the user when the device is in its operative position and can also be easily folded to a folded storage position for easy storage in the home or shipping. More specifically, the exercise device includes rollable members mounted at the opposite longitudinal end of the frame structure which enable the user to easily move the exercise device when the same is in its operative position. The rollable members are constructed and arranged to allow a user to grasp the exercise support and pivot the one longitudinal end of the frame structure upwardly with respect to the horizontal surface about the rollable members and then push or pull on the exercise support to roll the frame structure in a desired direction.

The exercise device includes hinge structure to provide the folding movement of the frame structure between the operative position and the folded storage position in which the frame structure extends generally vertically with respect to the horizontal surface. The hinge structure is constructed and arranged such that when the frame structure is in its operative position, the frame structure can be folded by raising the frame structure upwardly about the hinge structure. The exercise support and the arched array of rollers are constructed and arranged such that the exercise support and a plurality of rollers at the opposite longitudinal end of the arched array cooperate to support the frame structure on the horizontal surface in the folded storage position.

Other objects, features, and advantages of the present invention will become apparent from the following detailed description, the accompanying drawings, and the appended claims.

DETAILED DESCRIPTION OF THE PREFERRED EMBODIMENT AND BEST MODE OF THE INVENTION

Figure 1:
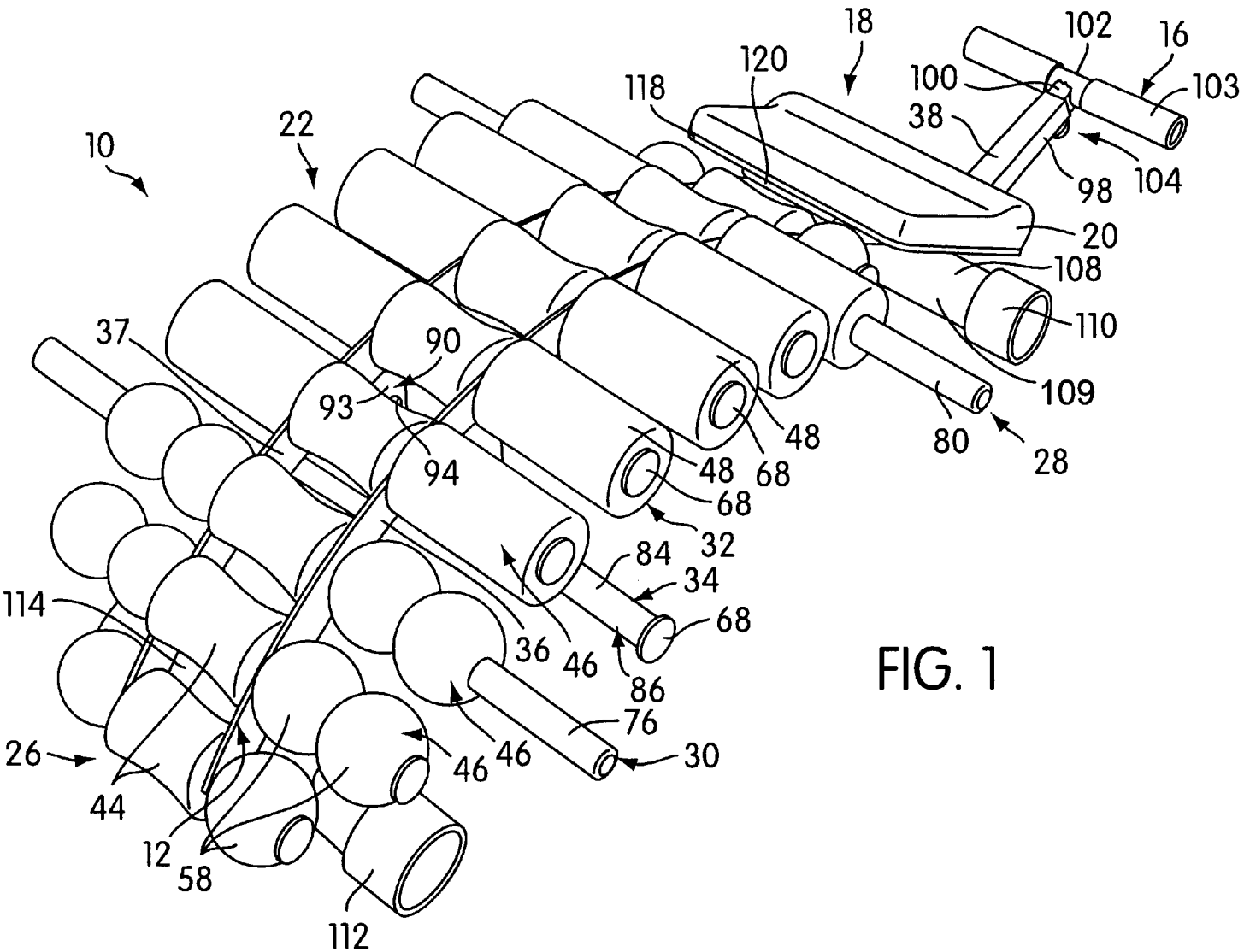
FIG. 1 is a perspective view of an exercise device in an operative position constructed according to the principles to the present invention.

FIGS. 1–8 show an exercise device, generally designated 10, constructed according to the principles of the present invention. The exercise device 10 includes a frame structure, generally designated 12, that is constructed and arranged to be supported in an operative position on a horizontal surface 14 (shown in FIGS. 2 and 8 only) so as to extend longitudinally therealong. An exercise support 16 is mounted on one longitudinal end 18 of the frame structure 12 in a position spaced above the horizontal surface 14 when the frame structure 12 is supported thereon in the operative position. The exercise support 16 is constructed and arranged to enable a user to engage the user's feet with the exercise support 16 or to grip the user's hands on the exercise support 16.

Figure 2:
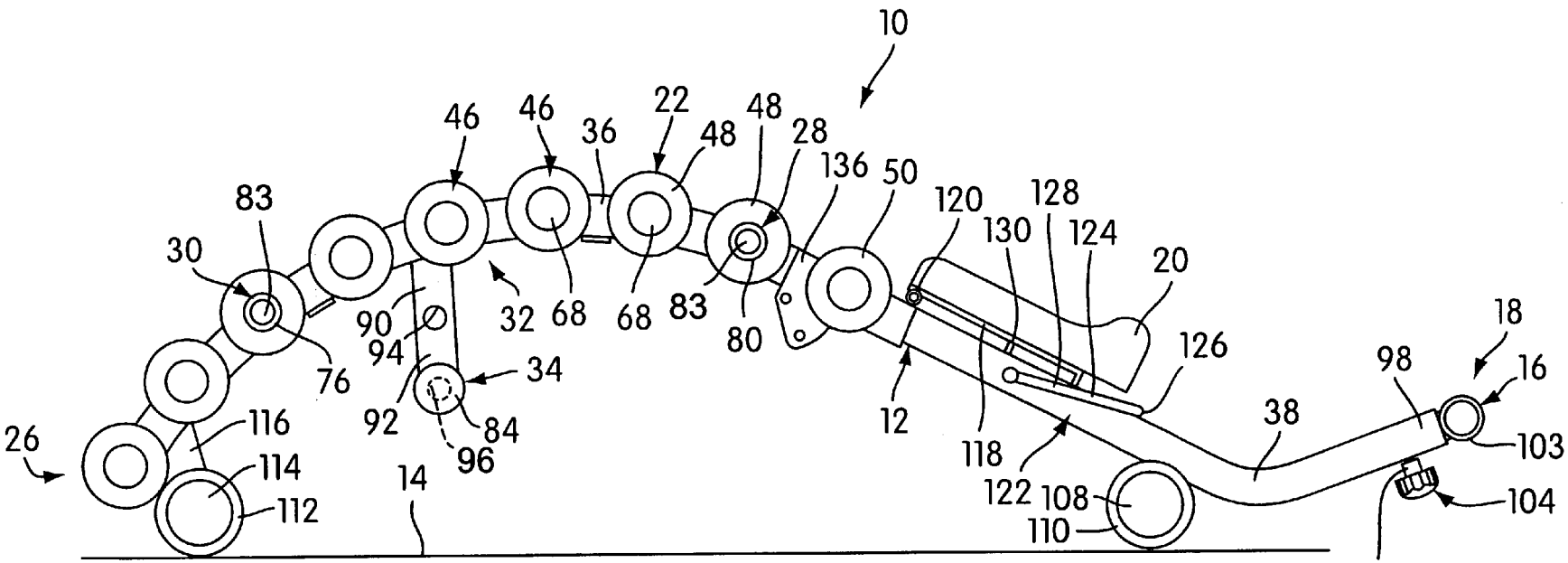
FIG. 2 is a side elevational view of the exercise device in the operative position.

A seat 20 is carried on the one longitudinal end portion 18 of the frame structure 12 in longitudinally spaced relation with respect to the exercise support 16 as shown, for example, in FIG. 2. A plurality of rollers, generally designated 22, made of a yieldable material are rotatably supported on the frame structure 12 in an upwardly arched array. As shown in FIG. 2, for example, the array of rollers 22 extends longitudinally upwardly from the seat 20 and then arches downwardly toward an opposite longitudinal end 26 of the frame structure 12. The array of rollers 22 is constructed and arranged to rollingly support a user thereon and each of the rollers 22 is preferably made of an appropriate foamed plastic or synthetic material to provide cushioned support for a user.

The exercise device 10 includes a plurality of pairs of hand grips to help a user get on and off of the exercise device 10 and to support and stabilize the user in various positions during various exercises. The frame structure 12 supports laterally spaced seat adjacent hand grips 28 carried by the frame structure 12 adjacent the seat 20. The frame structure 12 also supports a pair of laterally spaced opposite end hand grips 30 generally disposed on the opposite longitudinal end 26 thereof. An intermediate portion 32 of the frame structure 12 supports laterally spaced intermediate hand grips 34.

The frame structure 12 is preferably constructed of metal, the preferred metal being steel, although any metal of suitable strength can be used in the construction thereof. The frame structure 12 includes a pair of parallel, elongated longitudinally extending frame members 36, 37 and a tubular frame member 38 rigidly secured thereto. A plurality of longitudinally spaced, transversely extending shafts of various lengths, generally designated 40 (shown in phantom lines in the top view of the exercise device in FIG. 3), are mounted in a plurality of pairs of transversely aligned bores (not shown) in the frame structure 12, a bore of each pair being formed respectively in each of the two frame members 36, 37. When the shafts 40 are mounted in the frame members 36, 37, opposite outwardly extending portions, generally designated 42, of each of the shafts 40 extend laterally beyond respective frame members 36, 37. As can be appreciated from FIGS. 1–3, for example, the frame members 36, 37 are constructed and arranged to arch upwardly from the seat 20 and then downwardly towards the opposite longitudinal end 26 of the frame structure 12 and to cooperate with the plurality of shafts 40 to rotatably mounted the plurality of rollers 22 in the arched array.

More specifically, a central roller 44 is rotatably mounted on a central portion of each shaft 40 between the frame members 37, 38; and at least one pair of opposite side rollers, generally designated 46, are rotatably mounted on the respective opposite outwardly extending portions 42 of the shafts 40 and in abutting relation to the respective frame members 36, 37. As can best be appreciated from FIG. 1, each central roller 44 is elongated in the transverse direction and has a shallow arcuate groove formed along its length shaped to receive and support a spinal area of the user. The opposite side rollers 46 include elongated cylindrical rollers 48 and spherical rollers 50.

Figure 3:
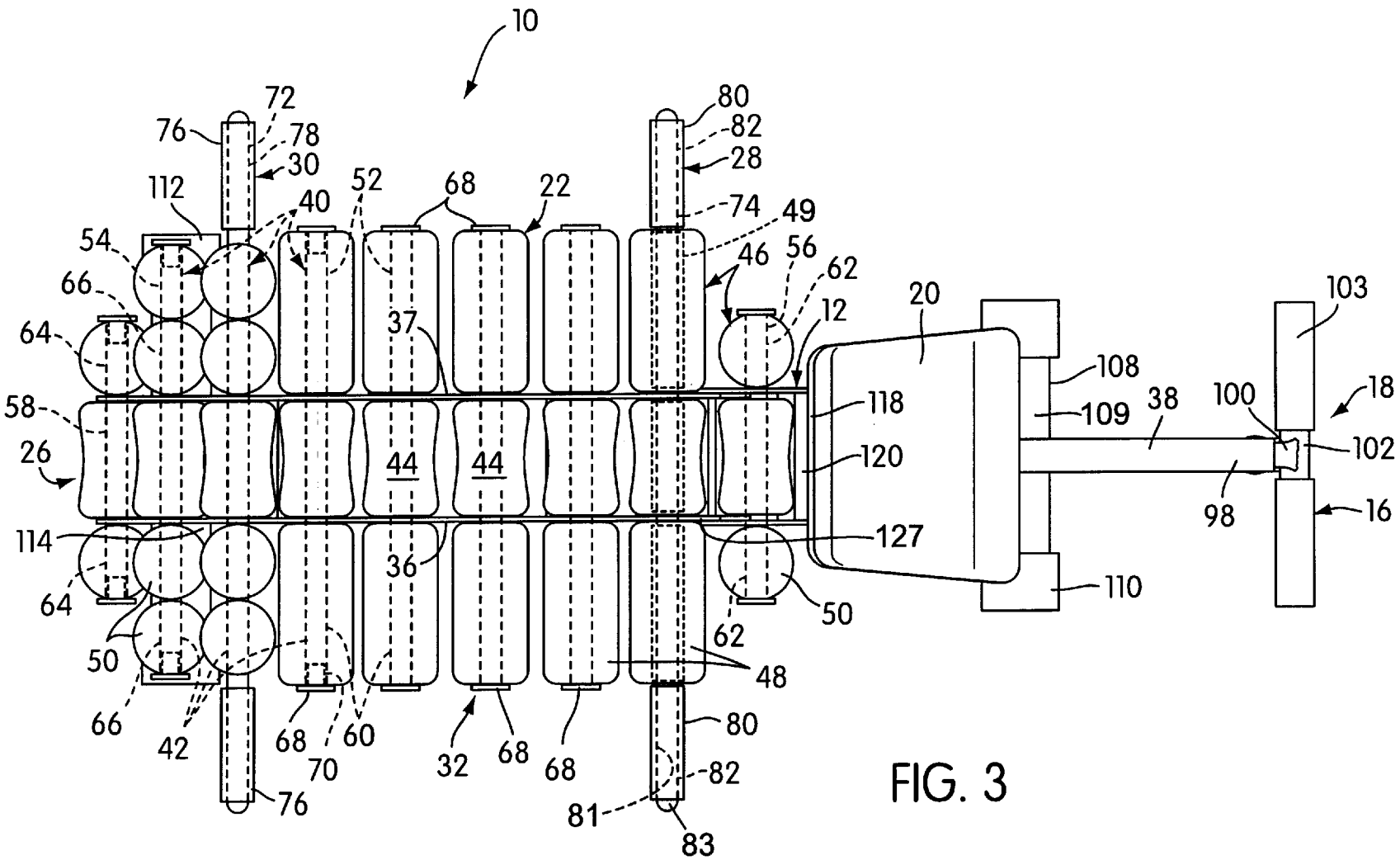
FIG. 3 is a top plan view of the exercise device in the operative position showing a plurality of shafts and endcaps thereof in phantom lines.

As best appreciated from FIG. 3, the plurality of shafts 40 includes a plurality of central shafts 52, a forward shaft 54, a seat adjacent shaft 56, and an opposite end shaft 58. The shafts 52, 54, 56, 58 are preferably identical in construction except that they vary in length as best appreciated from FIG. 3. Each shaft 52, 54, 56, 58 is preferably a hollow, tube-like cylindrical structure with open ends and is preferably constructed of an appropriate light weight, high strength metal such as aluminum although steel can also be used. Each roller 44, 48, 50 has a throughgoing central bore and a plastic sleeve 49 mounted in the bore. Each plastic sleeve 49 is sized to slidingly engage a respective shaft 52, 54, 56, 58 to rotatably mount each roller 44, 48, 50 thereon and minimize the frictional engagement between the rollers and the frame structure 12. Three representative plastic sleeves 49 are indicated by phantom lines in surrounding relation to one of the central shafts 52 in FIG. 3. The other sleeves 49 are not shown to more clearly illustrate the invention.

A pair of the elongated cylindrical rollers 48 are mounted on the opposite outwardly extending portions 60 each central shaft 52 in the intermediate portion 32 of the frame structure 12, each pair member being mounted on a respective end portion 60 thereof. A single spherical roller 50 is rollingly supported on the outer end portions 62 of the seat adjacent shaft 56 and a single roller 50 is rollingly supported on each outer end portion 64 of the opposite end shaft 58. A pair of spherical rollers 50 are rollingly supported on each outer end portion 66 of the forward shaft 54. Each roller 48, 50 is retained on the respective end portion 60, 62, 64 of a respective shaft 52, 54, 56, 58 by an end cap 68. Each end cap 68 is preferably made of a suitable plastic material and has a cylindrical extension 70 (shown in phantom on representative end caps 68 associated with shafts 54, 58 and one of the central shafts 52 in FIG. 3) integrally formed thereon which is press-fit into a respective end of a respective shaft 52, 54, 56, 58 and retained therein by an interference fit. It can be appreciated that this construction allow the user to easily mount and remove the shafts 40 and rollers 22 from the frame structure 12. The end caps 68 also provide a relatively soft protective structure on the end of the shafts in which they are mounted to protect the user from contact with the ends of a metal shafts during use of the exercise device 10.

The construction of the laterally spaced seat adjacent hand grips 28 and of the laterally spaced opposite end hand grips 30 can be appreciated from FIGS. 1–3. More specifically, an opposite end shaft 72 and a seat adjacent shaft 74 of the plurality of shafts 40 extend axially beyond the opposite side rollers 46 mounted thereupon and a pair of cushioned members 76 are mounted on respective opposite end portions 78 of the opposite end shaft 72 and a pair of cushioned members 80 are mounted on respective opposite end portions 82 of the seat adjacent shaft 74. The construction of the shafts 72, 74 is preferably identical to the construction of, for example, shaft 52 except that the shafts 72, 74 are longer to accommodate the grippable cushioned members 76, 80. The cushioned members 76, 80 are preferably made of a soft foamed plastic or synthetic material and are each provided with an central axial bore 81 sized allow each cushioned member 76, 80 to be pushed over a respective end of a respective shaft 72, 74 in tight frictional engagement therewith. The cushioned members 76, 80 thereby retain the rollers on the respective shafts 72, 74 and hold the shafts 72, 74 removeably in the frame members 36, 37. A plug member 83, preferably made of a suitable molded plastic, is provided in each end of each shaft 72, 74 to protect the user from an edge of a shaft 72, 74 during exercise.

Figure 4:
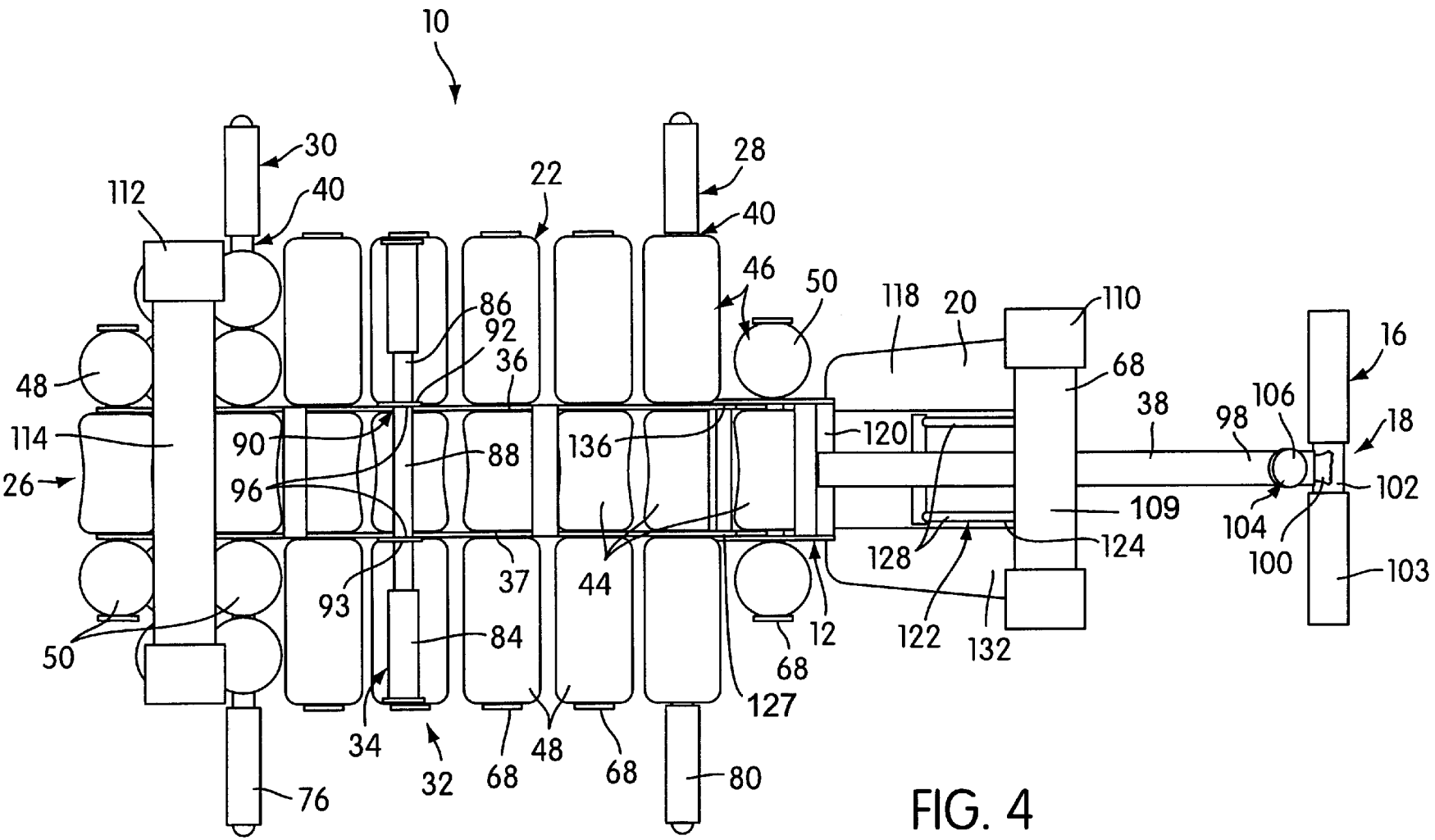
FIG. 4 of bottom plan view of the exercise device in the operative position.
Figure 5:
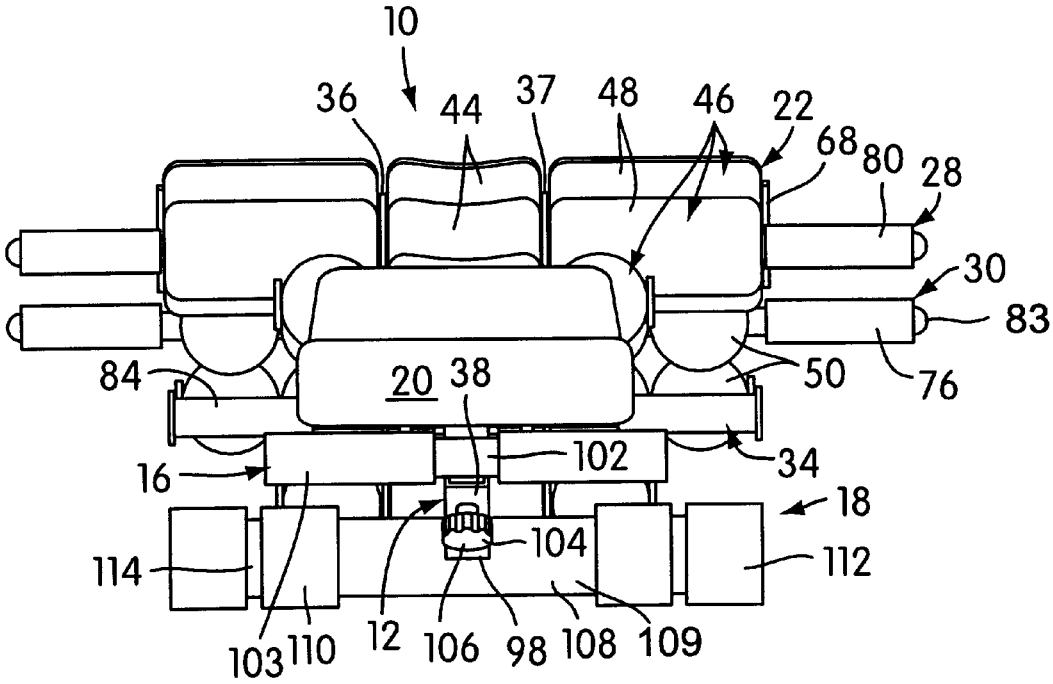
FIG. 5 is an elevational view of a longitudinal end of the exercise device.
Figure 6:
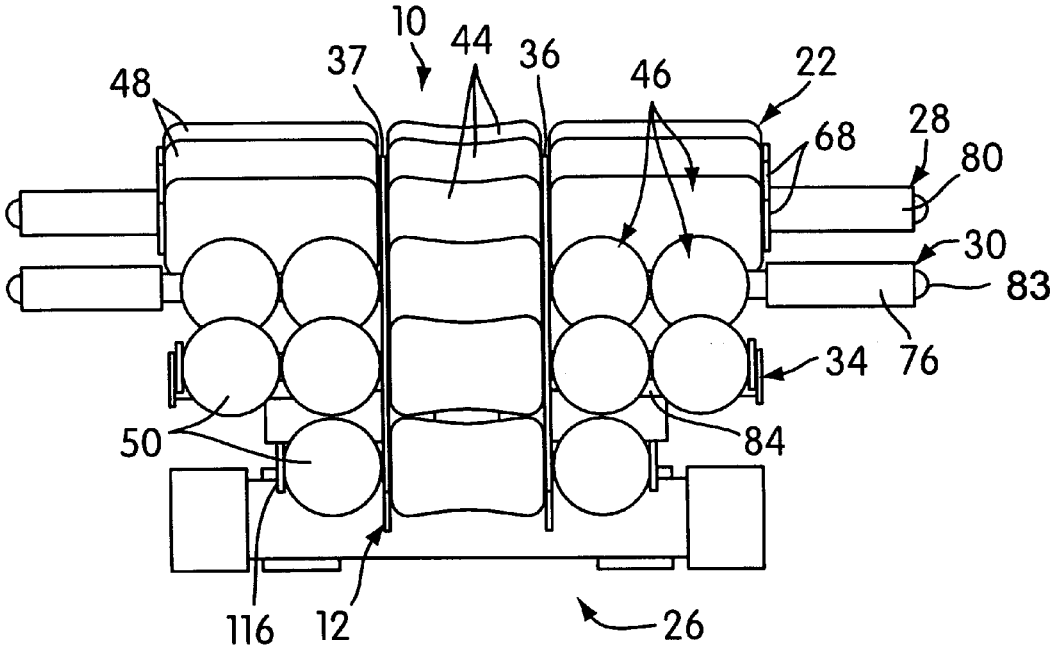
FIG. 6 is an elevational view of an opposite longitudinal end of the exercise device.

As best shown in FIG. 2, the intermediate hand grips 34 comprise a pair of cushioned members 84 mounted on opposite ends 86 (best seen in the bottom view of the exercise device 10 shown in FIG. 4) of an intermediate shaft 88. The construction of the cushioned members 84 is preferably identical to the construction of cushioned members 76, 80. The intermediate shaft 88 is carried by a support structure 90 rigidly security to the frame members 36, 37 and extending generally vertically downwardly therefrom. The construction of the intermediate shaft 88 is preferably the same as that disclosed for shaft 54, for example, except that shaft 88 is of different length.

The support structure 90 is comprised of two identical parallel members 92, 93 constructed of steel or other appropriate metal. The members 92, 93 are provided with two pairs of aligned apertures, generally designated 94, 96, one member of each pair 94, 96 being formed in a respective member 92, 93 to receive and support the intermediate shaft 88 in one of two possible spaced positions with respect to the frame structure 12. An end cap 68 is removably mounted in each end of the shaft 88 to retain the cushioned members 84 thereon and to hold the shaft 88 in the support structure 90.

The tubular frame member 38 extends longitudinally from and is rigidly fixed with respect to a seat adjacent end of the frame members 12. The tubular frame member 38 is preferably made of steel and is secured to the frame members 36, 37 by welding or other appropriate means. The tubular frame member 38 extends angularly downwardly therefrom and then upwardly to provide an upwardly angled tubular end 98 on the one longitudinal end of 18 of the frame structure 12. The exercise support 16 is mounted on the tubular end 98 of the tubular frame member 38 and preferably the exercise structure 16 is in releasably locked engagement with the frame structure 12 to allow the exercise support to be released from locking engagement therewith and moved with respect thereto in a generally longitudinal direction and then relocked to accommodate the arm length and leg length of the user. Although it is preferred for the exercise support 16 to be adjustably mounted to the frame structure 12, it is within the scope of the invention for the exercise support 16 to be rigidly, non-adjustably mounted thereto.

Preferably the exercise support 16 is a T-shaped member having a stem 100 and a cross support element 102. A free end of the stem 100 is telescopically mounted within the upwardly angled tubular end 98 of the tubular frame member 38 to allow movement of the cross support element 102 in a generally longitudinal direction with respect to the frame structure 12. Preferably the end 98 of the tubular frame member 38 and the stem 100 of the exercise support 16 have rectangular cross-sections to prevent rotation of the exercise support with respect to the end 98 of the member 38. A cushion member 103 (which is similar in construction to the cushioned members 76, 80, 84, differing therefrom only in size) is provided on each end of the cross support element 102 to provide a soft engaging surface for the user's feet and hands.

Releasable locking structure 104 is operatively associated with the tubular end 98 of the frame structure 12 and with the stem 100 of the T-shaped member to releasably lock the exercise support 16 with respect to the tubular frame member 38. The releasable locking structure 104 can be on any known conventional construction and preferably includes a locking pin 106, a pin receiving aperture (not shown) formed in the tubular end 98 and a series of pin-receiving apertures (not shown) formed in the stem 100 of the T-shaped member. The exercise of support 16 is locked in place by inserting the locking pin 106 through the aperture in the tubular end 98 and into one of the pin-receiving apertures in the T-shaped member. The structure of the locking pin 106 can be spring-biased into locking engagement with the selected aperture in the T-shaped member or can be constructed to threadedly engage suitable threaded structure formed on the end 98 of the tubular frame member 38 to retain the pin in locking engagement with the end 98 and stem 100.

A surface engaging member 108 is rigidly secured to an intermediate portion of the tubular frame member 38 and engages the horizontal surface to support the end portion 18 of the frame structure. The surface engaging member 108 includes a cylindrical metal structure 109 rigidly secured to the tubular frame member 38 by welding or by other conventional means and a plastic or rubber ground engaging sleeve 110 at each end thereof.

A pair of rollable members 112 are mounted at the opposite longitudinal end 26 of the frame structure 12. The rollable members 112 are constructed and arranged to allow a user to grasp the exercise support 16 and pivot the one longitudinal end 18 of the frame structure 12 upwardly with respect to the horizontal surface 14 about the rollable members 112 and then push or pull on the exercise support 16 to roll the frame structure 12 in a desired direction. The rollable members 112 are rubber or plastic wheel-like structures and are rotatably disposed on opposite ends of a tubular metal structure 114. The tubular metal structure 114 is in turn rigidly secured to the opposite end 26 of the frame structure 12 by a pair of downwardly extending arm members 116 rigidly secured to the frame members 36, 37. The structure 114 and the arm member 116 are preferably made of steel and secured to the frame structure 12 by welding or other suitable means. The ground gripping frictional engagement of the sleeves 110 on the ground engaging member 108 prevents the rolling movement of the frame structure 12 on the horizontal surface 14 during exercise. More specifically, the wheel-like structures 112 are each mounted for rotation in a longitudinally plane with respect to the frame structure 12 so that they cannot rollingly move the opposite longitudinal end 26 of the frame structure 12 in a transverse direction when the device 10 is in its operative position. The sleeves 110 are constructed and arranged to prevent longitudinal displacement of the frame structure 12 with respect to the horizontal surface 14 during use of the device 10 and the structures 108, 112 cooperate to prevent transverse movement of the device 10 when the same is in its operative position.

The structure of the seat 20 and the manner in which it is mounted to the frame structure 12 can be appreciated from FIGS. 2, 4, 5 and 7. The seat 20 is preferably constructed of a vinyl or a leather covered cushion mounted on a rigid base member 118. The seat 20 is pivotally mounted to the frame structure 12 by a hinge 120 that is mounted between the base member 118 and the tubular frame member 38 as best seen, for example, in FIG. 7. The frame structure 12 includes releasable retaining structure 122 operatively associated with the seat 20 to selectively releasably retain the seat 20 in a plurality of positions including an upwardly inclined position, a generally level position and a downwardly inclined position The releasable retaining structure 122 includes a substantially U-shaped bale 124 having a bight portion 126 and parallel leg portions 128 extending therefrom. Each leg 128 terminates in a free end and the free end of each leg 128 is pivotally mounted to the tubular frame member of the frame structure 12. The releasable retaining structure 122 further includes a plurality of longitudinally spaced flanges 130 mounted on a bottom surface 132 of the seat 20. Each flange 130 extends downwardly from the bottom surface 132 of the seat 20 and extends transversely with respect to the seat 20. The releasable retaining structure 122 is constructed and arranged such that the bight portion 126 of the bale 124 can be pivoted to engage is selected flange 130 to selectively retain the seat 20 in a selected seat position as shown, for example, in FIG. 7.

The frame structure 12 of the exercise device 10 includes hinge structure 136 to provide folding movement of the frame structure 12 between the operative position (shown, for example, in FIG. 2) and a folded storage position (shown in FIG. 8) in which the frame structure 12 extends generally vertically with respect to the horizontal surface 14. The hinge structure 136 is constructed and arranged such that when the frame structure 12 is in its operative position, the frame structure can be folded by raising the central portion thereof upwardly about the hinge structure 136. The exercise support 16 and the arched array of rollers 22 are constructed and arranged such that the exercise support 16 and a plurality of rollers at the opposite longitudinal end 26 of the arched array 22 cooperate to support the frame structure 12 on the surface 14 in the folded storage position. The hinge structure 136 includes two identical hinge members 127, each mounted on a respective frame member 36, 37.

Figure 7:
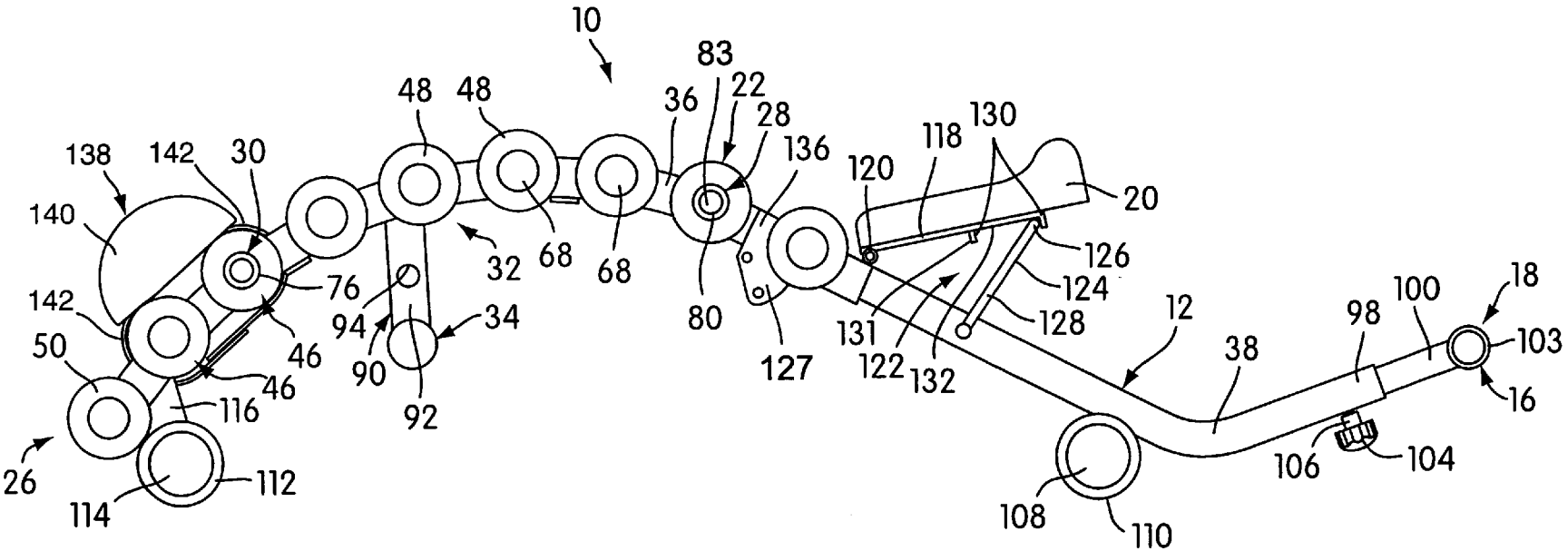
FIG. 7 is an elevational view of the exercise device similar to the view of FIG. 2, but showing a seat thereof in a level position and showing an optional removable pillow mounted to the exercise device.
Figure 8:
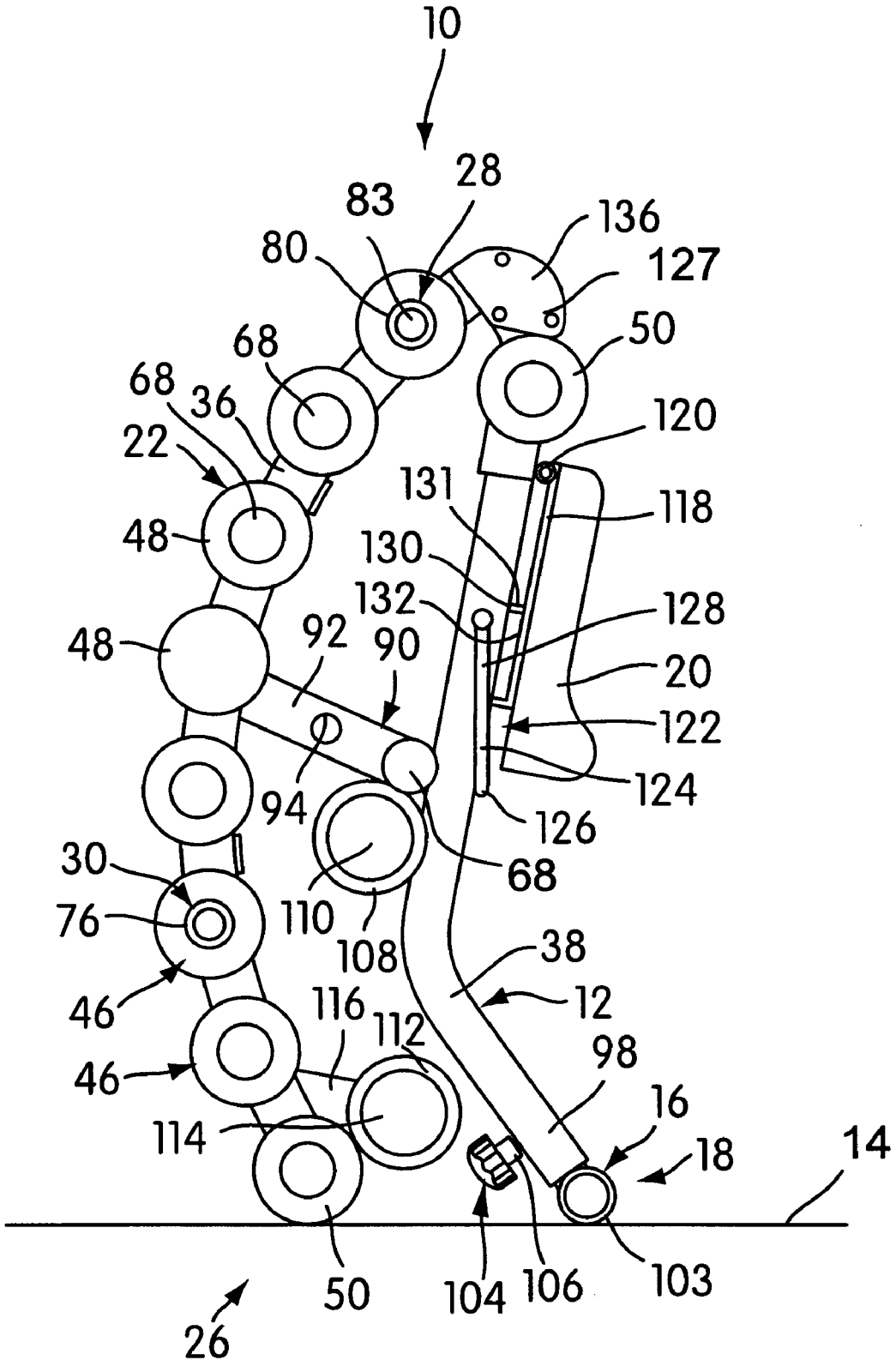
FIG. 8 is a side elevational view of the exercise device in a folded position.

The exercise device 10 includes a pillow 138 that is constructed and arranged to be removably mounted on at least one of the rollers 22 adjacent the opposite end 26 of the frame structure 12 in a position over the at least one roller to support the user's head when the user's back is supported on the rollers that are arrayed from the at least one roller toward the seat 20. The pillow 138 is shown in FIG. 7 mounted on two adjacent central rollers 44 (not visible in FIG. 7) at the opposite longitudinal end 26 of the frame structure 12. The pillow 138 is not shown in the other figures to more clearly illustrate the invention and because use of the pillow 138 is optional at the discretion of the user. The pillow 138 includes a cushioned pillow member 140 and two straps 142 mounted on opposite edges of the pillow member 140. The free ends of each strap 142 is provided with a Velcro patch (not shown) to allow the user to easily remove and reattach the pillow 138 to any central roller 44 or any two adjacent central rollers 44 on the exercise device.

Operation

The exercise device 10 is a comprehensive spinal health device that can provide a complete workout for the muscles of the spine and associated muscle groups throughout the body. An individual can use the exercise device 10 to support various portions of the body in various positions to perform a wide range of exercises to stretch and strengthen the muscles and connective tissue of the spine, back, abdomen, hips, neck, arms and legs. A number of different comprehensive exercise programs can be designed for individuals of all ages and physical conditions by selecting a set of exercises for a particular individual from among the exercises that can be performed using the exercise device 10. The operation of the exercise device 10 is illustrated below by describing a typical exercise routine for general spinal fitness and conditioning appropriate for a healthy adult. Although it is within the scope of the present invention to provide an exercise routine that utilizes the exercise device 10 for treating specific back problems and/or rehabilitation of specific back injuries, these routines will not be considered.

The exemplary exercise routine begins with neck stretches. The top seven vertebrae of the neck allow bending and turning of the head and these stretching exercises increase flexibility of this area of the spine and warm the body up for more rigorous exercises undertaken later in the workout routine. This portion of the spine is referred to as the cervical spine. With the seat 20 in the generally horizontal position (as shown in FIG. 7), the user sits on the seat 20 with his or her feet on the horizontal surface 14 and with his or her back straight, facing away from the arched array of rollers 22. The first exercise is a side tilt of the head performed by tilting the head sideways toward the right shoulder, holding this position for five seconds, then tilting the head sideways toward the left shoulder and holding this position for five seconds. This exercise is repeated five times on each side. The next neck stretching exercise is a resisted side tilt of the head in which the user tilts his head to his right shoulder then places of the fingertips of the right hand on the left side of the head and tries to straighten his neck while providing mild resistance against this movement with the fingertips of the right hand. This exercise is then performed on the left side and is repeated five times on each side.

The next neck stretching exercise is neck rotation in which the user turns his head to the right side of his body and holds this position for five seconds. The same exercise is performed on the left side of the body and this exercise is repeated five times on each side. The next neck exercise is resisted rotation of the head and neck in which the user turns his head to the right side of his body, places his left palm on his left temple and then tries to rotate his head back to its forwardly facing position while resisting this movement with his left hand. The user resists this movement for five seconds and then performs this exercise on the left side of the body. This exercise is repeated five times on each side.

The next exercise for the neck is a forward tilt. With the head in a forwardly facing, straight, erect position, the user bends his head forward and holds it in its bent position for five seconds. This exercise is repeated five times. The user then performs back tilts of the head by bending the head and neck rearwardly by lifting his head out of his shoulders and holding this position for five seconds. This exercise is repeated five times. The user then performs a set of chin tucks. With the user's head held up in a straight, erect position, the user tucks his chin in and holds this position for three seconds. This exercise is repeated five times. Next, the user performs a set of shoulder shrugs. Shoulder shrugs are performed by sitting up straight, with erect position and lifting both shoulders upwardly and holding them in this raised position for five seconds and then lowering them. This exercise is repeated five times. The user then performs a series of shoulder roles by sitting in the straight, erect position and rolling both shoulders five times in each rotational direction. This exercise is repeated five times.

After this series of neck exercises is complete, exercises involving the vertebrae in the central portion of the spine and the lumbar region of the spine are commenced. When the scat 20 of the exercise device 10 is in its downwardly inclined position (as shown, for example, in FIG. 2), the user can accomplish back decompression, lower back, or side stretches while supported supine, prone or on a side, respectively, on the seat 20 and the rollers 22 with the user's feet engaged with the exercise support 16. More specifically, the user can decompress the discs of the spine by positioning himself supine on the device 10. This can be accomplished by placing the buttocks on the downwardly inclined seat 20, hooking use feet under the cross support element 102 of the exercise support 16 and then curling the back rearwardly from the base of the spine until the entire back is supported on the arched array of rollers 22 of the exercise device 10. Both arms can then be lifted past the head downwardly toward the horizontal surface 14 in an arm stretching movement and the user can then perform arm circles with both arms. The user does three arm circles in each direction. It can be appreciated that the user can adjust the position of the cross support element 102 in the generally longitudinal direction by repositioning the stem 100 with respect to the end 98 of the tubular frame member 38 to accommodate the user's height and leg length. The user next roles his back over the rollers 22 by placing his hands on the intermediate hand grips 34 and then uses his arms to roll his body back and forth over the array, allowing the foam rollers 22 to massage the back muscles and spine. This rolling and stretching movement should be continued for 30 seconds.

Lower back stretches can also be accomplished with the seat 20 in its downwardly inclined position. To stretch the lower back, the user lies across the array of rollers 22 in a prone position on his stomach. The user's feet are placed underneath the exercise support 16 in hooking engagement with the cross support element 102 and the user's arms are straight and stretched completely out. The user holds this position for 30 seconds. The user next performs a chest stretch and a quadricep stretch while in this prone position. To do the chest stretch, the user brings both hands behind his back and then lifts his head and torso upwardly off the rollers 22 so that the user's back is slightly arched. The user holds this position for five seconds and then releases. This exercise is repeated five times. To do the quadricep stretch, the user hooks his left foot under the cross support element 102, bends his right leg at the knee and then grasps his right foot with his right hand. The user then pulls gently on his right foot which stretches the quadricep muscles of the right leg. The user holds this position for five seconds and then releases of his leg. The user then stretches his left quadricep muscles in a similar manner. This exercise is repeated five times on each leg.

The user next uses the laterally spaced opposite end hand grips 30 while in the prone position to perform a push up movement of his upper body that stretches the lower back. More specifically, while lying across the arched array 22 and with the feet hooked beneath the exercise support 16, the user grasps the opposite end hand grips 30 and lifts is head and torso upwardly, slightly arching the back while straightening his arms to support his upper body weight. The user holds this position for three seconds and then releases. This exercise is repeated five times.

To perform side stretches, the user lies on his side across the arched array of rollers 22 while the seat 20 is in its downwardly inclined position. The user hooks his lower foot under the cross support element 102 and lifts his upper arms over his head, allowing the length of his body to conform to the shape of the arched array 22. The user holds this position for 30 seconds. This stretching exercise is repeated on both sides of the body. Next, the user performs the side stretch in combination with arm circles. In this exercise, the user lifts his upper arm over his head and makes continuous circular movements with this arm. This exercise is repeated with the user lying on his other side. The user repeats this exercise on each side three times in each direction of circular movement. The circular arm movement should be slow and precise.

The next exercise in the exemplary routine are side crunches. While lying on one of his sides across the array of rollers 22 and with the lower foot in hooking engagement with the cross element 102, the user places his hands behind his head and then lifts his torso upwardly off the rollers 22 so that his body is more or less straight and holds this position for three seconds before releasing. This exercise is repeated five times on each side. The user then performs side single leg lifts. While lying on one of his sides on the arched array of rollers 22 and with the lower foot in hooking engagement with the cross element 102, the user rests his head on his lower hand (with the elbow of that hand resting on the arched array of rollers 22), points the toes on his upper leg and then lifts and lowers the upper leg, keeping the leg straight. The leg is held in the raised position for three seconds before lowering. This exercise is repeated five times on each side. The user then performs side single leg circles. Side single leg circles are performed with the lower foot in hooking engagement with the cross element 102 and with the head resting on and supported by the lower hand as described immediately above. With the foot of the upper leg pointing straight out, the user lifts this upper leg and performs a complete leg circle. The leg circles are a repeated three times in each direction. The user then switches sides and performs the leg circles on the opposite leg.

The frame structure 12 supports the pair of laterally spaced opposite end hand grips 30 in a position to enable a user to accomplish lumbar stretches wherein the user supports the user's torso above the rollers 22 by engaging the user's knees on the seat 20 when the seat is in the level position and holding onto the opposite end hand grips 30 with outstretched arms. More specifically, the user can perform a fetal stretch while in this basic position. To perform a fetal stretch, the user kneels on the level seat 20, relaxes into a fetal position with the back somewhat rounded and with the buttocks positioned by the user's heels and then grasps the opposite end hand grips 30 with outstretched arms. The user holds this position for 10 seconds. The user next, from this fetal stretch position, moves into a cat stretch of the lumbar region. To accomplish this, the user, while kneeling on the seat 20 with the buttocks moved upwardly from the heels so that the thighs are approximately perpendicular to the horizontal surface, and holding the opposite end hand grips 30, arches his back, pulling inwardly with the stomach muscles, and lowers his head. The user maintains this position for 10 seconds and then relaxes. The next lumbar stretch that is performed in this basic body position is a cow stretch. The cow stretch is performed while kneeling on the seat 20 with the thighs approximately perpendicular to the horizontal service 14 and while grasping the opposite end hand grips 30. The user curves his spine downwardly and sticks out his buttocks. The user holds this position for 10 seconds and then releases.

Next, the lower back and abdominal areas are stretched with the seat 20 in the upwardly inclined position. The upwardly inclined position of the seat is not shown in the figures, but this position is realized when they U-shaped bale 124 engages flange 131 on the seat 20. When the seat 20 is in the upwardly inclined position, the user is able to accomplish lower back or abdomeninal stretches wherein the user is supported on the seat 20 and on the adjacent rollers in a generally seated position with the user's feet in the air or supported by the exercise support 16, respectively. More specifically, the user can perform a lower back stretch while sitting on the inclined seat 20 facing the exercise support 16 with the user's back resting against the rollers 22 adjacent to seat 20 by bringing his knees into the chest, placing his hands on the knees have gently pulling the knees into the chest. The user holds this position for 10 seconds. The user can then perform the next stretching exercise, a groin stretch, from this position by opening both his knees to opposite sides and then gently pulling the knees apart with the respective hands. The user continues this groin stretching movement for 10 seconds.

The user can performed a single knee stretch, one leg at a time, while sitting on the upwardly inclined seat in the same position described for the lower back stretch by raising the right leg to a 45 degree angle, keeping the right leg straight, while bending the left leg at the knee, bringing the left knee up to the chest. The user holds this position for five seconds. This single knee stretching exercise is repeated keeping the left leg straight and bending the right knee. This stretching exercise is performed a total of 10 repetitions on each leg. The user can performed hamstring stretches by moving the seat 20 to its downwardly inclined position, placing the buttocks on the seat and the feet on top of the cross element 102. The user straightens his legs and bends at the waist, lowering his head toward his knees as far as he can go comfortable. The user holds this position for 10 seconds. For a more advanced hamstring stretch, the user can grasp the cross element 102 with his hands and pull.

To perform abdominal stretches, the user sits on the upwardly inclined seat with his feet under the cross element 102 and with his back straight. The user puts his hands behind his head and squeezes his abdominal muscles while leaning back at the waist and then moves back and forth from the waist through a range of approximately 4 inches. The user holds the rearwardmost position for three seconds before returning to center. The user repeats this exercise 10 times. The user then repeats this straight back abdominal stretching exercise with a twist. More particularly, the user, with his feet under the cross element 102 and with his back straight and his hands behind his head, twists to one side from the waist before moving back and forth. The user holds the rearwardmost position for three seconds before returning to center. The user repeats this exercise five times on each side.

The user then performs abdominal curls and abdominal curls with a twist to further strengthen and stretch the abdominal muscles. To perform the abdominal curls, the user, with his feet hooked under the cross element 102 and his hands behind his head, squeezes his chin to his chest while curling his back. The user holds this position for five seconds and returns to center. This exercise is repeated 10 times. To perform the curls with a twist, the user, with his feet hooked under the cross element 102 and with his hands behind his head, squeezes his chin to his chest while twisting to one side and curling his back. The user holds this position for five seconds and then twists in the reverse direction returning to center. This exercise is repeated five times on each side.

The laterally spaced seat adjacent hand grips 28 are carried by the frame structure 12 adjacent to the seat 20 in a position enabling a user seated on the seat 20 and the adjacent rollers with a seat in the upwardly inclined position and while facing away from the exercise support 16, to reach down and grip the seat adjacent hand grips to hold the position while the user's legs are moved in the air. This positioning allows the user to exercise his legs and hips as well as his abdominal muscles. More particularly, the user can perform single leg hip circles with the seat 20 in the upwardly inclined position, the small of the back resting on the seat 20 and the buttocks resting on the rollers 22 adjacent to the seat 20. The user, holding onto the seat adjacent hand grips 28, lifts the legs, keeping them straight and together. The user then makes a circular motion with the legs in both rotational directions, five times in one direction and then five times in the opposite direction. As the user performs this circular leg motion, he pushes his waist into the rollers and squeezes his abdominal muscles. The next exercise the user performs is a hip scissors exercise. This exercise is performed with the user positioned on the device 10 as described above for in the single leg hip circles and while grasping the seat adjacent handles 28. With his back pushed firmly against the seat 20, the user lifts his legs keeping them apart until they are directed generally upwardly and form a V-shaped configuration. The user then, keeping as leg straight, moves his legs back and forth in a scissors movement. This exercise is repeated five times. The user then performs leg lowers in basically the same body position as was assumed to perform the single leg hip circles. With the back pushed firmly against seat 20, the user lifts his legs keeping them together and straight with the toes pointed. The user then raises and lowers his straight legs five times.

After the back muscles and related muscle groups are stretched out and the body is warmed up, more rigorous back strengthening exercises can be undertaken. The user can accomplish a series of lower back strengthening exercises by placing his chest on the seat 20 when the seat is in its generally horizontally extending position and holding onto the exercise support 16 with outstretched arms to permit the legs to be moved in the air. More particularly, the user can perform single leg lifts by lying across the upwardly arched array of rollers 22, placing his chest on the level seat 20 and the grasping the exercise support 16. The user can then lift his left leg while keeping the leg straight and the toe pointed, holding the left leg in the raised position for five seconds and then lower the left leg. This exercise is repeated five times with the left leg and then five times with the right leg. The next lower back strengthening exercise is single leg lifts with arms raises. The user again lies on the arched array of rollers 22 with his chest on the level seat 20 and grasps the exercise support 16. The user lifts his left leg to agree raised position (while keeping the leg straight and the toe pointed) and at the same time lifts his right arm, keeping the right arm straight. The user holds the arm and leg in these raised positions for five seconds then lowers them. This sequence is repeated five times on each side.

The next lower back strengthening exercise is again performed by lying prone on the arched array of rollers 22 with the chest on the level seat 20 and grasping the exercise support 16 with both hands. The user lifts both legs, lifting the left leg a little higher than his right leg and moves the legs in and out simultaneously, making sure that the feet cross during leg movement and that the abdominals are taut. The next exercise involves a swimming movement of the legs. While the user is in the same prone position as in the immediately preceding exercise, the user lifts both legs, lifting his left leg a little higher than his right leg, and then moves his legs up and down as is done when swimming. The legs should be straight and the abdominals taut during this exercise. The exercise is repeated 10 times. The next lower back strengthening exercise is called a grass hopper exercise and is performed in the same basic prone position used in the two immediately preceding lower back strengthening exercises. The legs are pressed together and then bent at the knee until the feet touch or come close to the buttocks. The legs are then moved generally upwardly in a continuous movement with the feet moving generally upwardly toward the ceiling and then outwardly in a leg straightening movement and then the straight legs are lowered to their beginning position to complete one cycle of the exercise. This exercise is repeated five times.

As described above, the frame structure 12 supports laterally spaced intermediate hand grips 34 on an intermediate portion of the frame structure in an upper back strengthening position enabling a user, positioned with the user's back engaging the rollers 22, the user's head and shoulders on a floor pad (not shown) extending from the opposite end 26 of the frame structure 12 and the user's legs extending upwardly in the air, to conveniently reach down below the rollers 22 and grip the intermediate hand grips 34 with both hands to allow the user to retain the user's head, shoulders and back in the upper back strengthening position while the user's legs are moved in the air. More specifically, while the user is lying with his head and shoulders on the mat, his lower back supported on the rollers 22 at the opposite longitudinal end 26 of the frame structure 12 as described immediately above, the user can extend his legs directly up into the air and perform single leg circles by moving his legs apart slightly and moving each leg in a circular direction five times in each rotational direction. The user then performs a pelvic roll exercise by lying with his back and buttocks on the mat and placing his legs over the arched array of rollers 22 so that they bend to the curve thereof. The user then tips his pelvis upwardly, holds it in the raised position for 10 seconds and then relaxes. This exercise is repeated five times.

The next upper back strengthening exercise is performed by beating the raised legs in the air. This beating exercise is performed by placing the head and shoulders on the mat, the upper back and buttocks on the rollers 22 and grasping the intermediate hand grips 34. The user raises his legs upwardly from the arched array until only is shoulders are touching the mat. With the legs straight and pointing toward the ceiling, the user flutters both his legs back and forth at the same time. This exercise is repeated 10 times. The next upper back strengthening exercise is called a front scissors exercise and is performed while the user is in the same basic posture used when performing the immediately preceding leg beating exercise. While keeping both legs straight, the user positions one leg fully forwardly and the other fully rearwardly and then moves them back and forth in a continuous, front to back scissors like movement for 10 repetitions. The next upper back strengthening exercise is called a walking exercise and is performed while the user is in the same basic posture used when performing the preceding leg beating exercise. In the walking exercise, the legs are raised straight toward the ceiling and then moved slowly back and forth in a small scissors-like movement while both legs simultaneously move downwardly toward the arched array 22 and then back upwardly to the raised position. This exercise his repeated five times.

Following this series of upper back strengthening exercises, this exemplary exercise routine ends with a cooling down sequence. The user slides his back down the arched array of rollers until his back and waist are on the mat and his legs are lying over the arched array 22. The user inhales deeply and slowly lifts his pelvis and lower back of the mat while supporting his body with his heels against the arched array of rollers 22 and his shoulders, head, neck and arms lying on the mat. The user holds his lower back and pelvis above the mat for five seconds and then lowers them. This exercise is repeated five times. The next cooling down exercise is a rollover and is performed by lying on the mat with the back and waist thereon and the feet resting on the arched array 22 with the knees bent. The user then rolls his knees over to the right side of his body to stretch the lower back, hips and thighs. The user holds this position for five seconds and repeats this exercise five times on each side. This is the final exercise in the exemplary routine.

It can be appreciated that because the shafts 52, 54, 56, 58, 72, 74 are of identical construction except that they are of different lengths and because they are removably mounted in the frame member 36, 37, the positions of the shafts 52, 54, 56, 58, 72, 74 are interchangeable in the frame members 36, 37 so that the handle 28, 30 positions can be changed to accommodate the arm length and body size of an individual of the exercise device 10. More specifically, the opposite end shaft 72, for example, can be easily removed from the frame members 36, 37 by removing one of the cushioned members 76 thereon and the forward shaft 54, for example, can be easily removed from the frame members 36, 37 by removing one of the end caps 68 therefrom. The positions of the shafts 72 and 54 can then be easily changed to move the laterally spaced opposite end hand grips 30 toward the opposite longitudinal end 36 of the frame structure 12.

Similarly, the intermediate shaft 88 can be easily removed from the support structure 90 by removing an end cap 68 and a cushioned member 84 from one end of the shaft 88 and the shaft 88 can then be repositioned with respect to the frame members 36, 37 by inserting the shaft 88 in either the upper pair of apertures 94 or the lower pair of apertures 96 formed in the support structure 90. It can therefore be understood that the laterally spaced intermediate hand grips 34 carried by the shaft 88 can be repositioned with respect to the frame members 36, 37 to accommodate the body size of an individual user of the exercise device 10.

The exercise device 10 can be easily moved across the horizontal surface 14 while in the operative position by simply grasping the exercise support 16 and lifting the one longitudinal end 18 of the frame structure 12 upwardly about the rollable members 112 and then pushing or pulling on the exercise support 16 to role the exercise device 10 therealong. This allows the user to easily moved from the exercise device 10 to a storage location. The exercise device can then be easily folded to the storage position by pushing the center portion of the exercise device 10 upwardly. This causes the frame structure 12 to pivot about the hinge structure 136 and fold into the storage position shown in FIG. 8.

It can also be appreciated that because the frame structure 12 is foldable and because the shafts 52, 54, 56, 58, 72, 74, 88 can be easily mounted in and removed from the frame structure 12, the exercise device 10 can be easily packaged for shipment by, for example, the manufacturer prior to sale and can be easily assembled by the user after purchase. The frame structure 12 can be shipped to the end user fully assembled and the user can then easily mount the shafts and rollers thereon at the point of use of the device 10. Because the frame structure 12 folds it can be easily packaged for shipment or for storage in inventory even when it is fully assembled. It can also be appreciated that because the exercise device 10 is mostly of steel construction (including the frame structure 12, the exercise support 16, the shafts 52, 54, 56, 58, 72, 74, 88), the exercise device 10 is highly durable. Because the exercise device 10 can be easily dissembled and reassembled by the user, the portions of the exercise device that are subject to wear (for example, the rollers 22 and cushioned members 76, 80, 84) can be easily removed and then replaced by the user.

It can thus be appreciated that the objects of the present invention have been fully and effectively accomplished. It is to be understood that the foregoing specific embodiment has been provided to illustrate the structural and functional principles of the present invention and is not intended to be limiting. To the contrary, the present invention is intended to encompass all modifications, substitutions and alterations within the spirit and scope of the appended claims.

It should be noted that limitations of the appended claims have not been phrased in the "means or step for performing a specified function" permitted by 35 U.S.C. § 112, ¶6. This is to point out clearly the intent that the claims are not to be interpreted under § 112, ¶6as being limited solely to the structures, acts and materials disclosed in the present application or the equivalents thereof.

What is claimed is:

1. An exercise device comprising:

a frame structure constructed and arranged to be supported in an operative position on a horizontal surface so as to extend longitudinally therealong, an exercise support mounted on one longitudinal end of said frame structure in a position spaced above the horizontal surface when said frame structure is supported thereon in an operative position, said exercise support being constructed and arranged to enable a user to engage the user's feet with said exercise support or grip the user's hands on said exercise support, a seat carried on said frame structure in longitudinally spaced relation with respect to said exercise support, a plurality of rollers made of yieldable material rotatably supported on said frame structure, said plurality of rollers including (a) an upwardly arched array of said rollers that extends both longitudinally away from said seat toward an opposite longitudinal end of said frame structure and upwardly away from the horizontal surface when said frame structure is in said operative position and (b) a downwardly arched array of said rollers that extends both longitudinally away from said upwardly arched array toward the opposite longitudinal end of said frame structure and downwardly towards the horizontal surface when said frame structure is in said operative position, said plurality of rollers being constructed and arranged to rollingly support a user thereon, said seat being positioned longitudinally adjacent said upwardly arched array and being inclined in substantially the same direction as said upwardly arched array so as to enable a user to (a) accomplish back decompression, lower back or side stretches while supported supine, prone or on a side, respectively, on said seat and said rollers with the user's feet engaged with said exercise support or (b) to accomplish lower back strengthening exercises while supported prone on said seat and rollers with the user's hands gripping said exercise support with outstretched arms.

2. The exercise device as defined in claim 1 wherein said seat is releasably retainable on said frame structure in a range of positions including a downwardly inclined position wherein said seat is inclined as aforesaid in substantially the same direction as said upwardly arched array and a level position wherein said seat extends generally horizontally enabling a user to accomplish lower back strengthening exercises wherein the user's chest is supported on said seat and the user holds on to said exercise support with outstretched arms to permit the legs to be moved in the air.

3. The exercise device as defined in claim 2 wherein said frame structure supports a pair of laterally spaced opposite end hand grips disposed in a position to enable a user to accomplish lumbar stretches wherein the user supports the user's torso above the rollers by engaging the user's knees on the seat in said level position and holding onto said opposite end hand grips with outstretched arms.

4. The exercise device as defined in claim 3 wherein said range of positions of said seat includes an upwardly inclined position wherein said seat inclines upwardly with respect to said level seating position enabling a user to accomplish lower back or abdominal stretches wherein the user is supported on the seat and the adjacent rollers in a generally seated position with the user's feet in the air or supported by said exercise support respectively.

5. The exercise device as defined in claim 4 wherein said frame structure supports laterally spaced seat adjacent hand grips carried by said frame structure adjacent said seat in a position enabling a user seated on said seat and the adjacent rollers with said seat in said upwardly inclined position while facing away from said exercise support to reach down and grip said seat adjacent hand grips to hold the position while the user's legs are moved in the air.

6. The exercise device as defined in claim 5 wherein said frame structure supports laterally spaced intermediate hand grips carried by an intermediate portion of said frame structure in an upper back strengthening position enabling a user positioned with the user's back engaging said rollers, the user's head and shoulders on a floor pad extending from the opposite end of said frame structure and the user's legs extending upwardly in the air to conveniently reach down below the rollers supporting the user's back and grip the intermediate hand grips with both hands to allow the user to retain the user's head, shoulders and back in said upper back strengthening position while the user's legs are moved in the air.

7. The exercise device as defined in claim 6 wherein said exercise support is in releasably locked engagement with said frame structure to allow said exercise support to be released from locking engagement therewith and moved with respect thereto in a generally longitudinal direction and then relocked to accommodate the arm length and leg length of the user.

8. The exercise device as defined in claim 7 further including rollable members mounted at said opposite longitudinal end of said frame structure, said the rollable members being constructed and arranged to allow a user to grasp said exercise support and pivot the one longitudinal end of said frame structure upwardly with respect to the horizontal surface about said rollable members and then push or pull on the exercise support to roll said frame structure in a desired direction.

9. The exercise device as defined in claim 8 wherein said frame structure includes hinge structure to provide folding movement of said frame structure between said operative position and a folded storage position in which said frame structure extends generally vertically with respect to said horizontal surface, said hinge structure being constructed and arranged such that when said frame structure is in the operative position thereof, the frame structure can be folded by raising said frame structure upwardly about said hinge structure and said exercise support and said arched array of rollers being constructed and arranged such that said exercise support and a plurality of rollers at the opposite longitudinal end of said arched array cooperating to support said frame structure on said surface in the folded storage position.

10. The exercise device as defined in claim 9 wherein said seat is pivotally mounted to said frame structure and wherein said frame structure includes releasable retaining structure operatively associated with said seat to selectively releasably retained said seat in said downwardly inclined, said upwardly inclined and said level positions, said releasable retaining structure including a substantially U-shaped bale having a bight portion and parallel leg portions extending therefrom, each leg terminating in a free end and the free end of each of said legs of being pivotally mounted to said frame structure, said releasable retaining structure further including a plurality of longitudinally spaced flanges mounted on a bottom surface of said seat, each flange extending downwardly from said bottom surface and extending transversely with respect to said seat, the releasable retaining structure being constructed and arranged such that the bight portion of the bale can be pivoted to engage a selected flange to releasably retain said seat the selected seat position.

11. The exercise device as defined in claim 2 wherein said range of positions of said seat includes an upwardly inclined position wherein said seat inclines upwardly with respect to said level seating position enabling a user to accomplish lower back or abdominal stretches wherein the user is supported on the seat and the adjacent rollers in a generally seated position with the user's feet in the air or supported by said exercise support respectively.

12. The exercise device as defined in claim 11 wherein said seat is pivotally mounted to said frame structure and wherein said frame structure includes releasable retaining structure operatively associated with said seat to selectively releasably retained said seat in said downwardly inclined, said upwardly inclined and said level positions, said releasable retaining structure including a substantially U-shaped bale having a bight portion and parallel leg portions extending therefrom, each leg terminating in a free end and the free end of each of said legs of being pivotally mounted to said frame structure, said releasable retaining structure further including a plurality of longitudinally spaced flanges mounted on a bottom surface of said seat, each flange extending downwardly from said bottom surface and extending transversely with respect to said seat, the releasable retaining structure being constructed and arranged such that the bight portion of the bale can be pivoted to engage a selected flange to releasably retain said seat the selected seat position.

13. The exercise device as claimed in claim 6 wherein said frame structure includes a pair of parallel, elongated longitudinally extending frame members having a plurality of longitudinally spaced, transversely extending shafts mounted therein with opposite outwardly extending portions, said frame members being constructed and arranged to arch upwardly and then downwardly from said seat towards said opposite longitudinal end of said frame structure and to cooperate with said plurality of shafts to rotatably mount said plurality of rollers in said upwardly and downwardly arched arrays such that a central roller is rotatably mounted on a central portion of each shaft between said frame members and a pair of opposite side rollers are rotatably mounted on the respective opposite outwardly extending portions thereof and in abutting relation to the frame members such that when said user is being supported in a supine position on said rollers, the central rollers are positioned to receive and rollingly support a spine area of the user and the opposite side rollers are positioned to rollingly support respective sides of the back of the user.

14. The exercise device as defined in claim 13 wherein an opposite end shaft and a seat adjacent shaft of said plurality of shafts extend axially beyond the opposite side rollers thereon, said opposite end hand grips and said seat adjacent hand grips including cushioned members mounted on the outer extensions of said opposite end shaft and said seat shaft respectively and wherein said intermediate hand grips comprise cushioned members mounted on opposite ends of an intermediate shaft carried by a support structure rigidly secured to said frame members and extending generally vertically downwardly from an intermediate portion thereof.

15. The exercise device as defined in claim 1 wherein said seat is releasably retainable on said frame structure in a range of positions including a downwardly inclined position wherein said seat is inclined as aforesaid in substantially the same direction as said upwardly arched array and a level position and wherein said frame structure supports a pair of laterally spaced opposite end hand grips disposed in a position to enable a user to accomplish lumbar stretches wherein the user supports the user's torso above the rollers by engaging the user's knees on the seat in said level position and holding onto said opposite end hand grips with outstretched arms.

16. The exercise device as defined in claim 15 wherein said seat is pivotally mounted to said frame structure and wherein said frame structure includes releasable retaining structure operatively associated with said seat to selectively releasably retained said seat in said downwardly inclined, said upwardly inclined and said level positions, said releasable retaining structure including a substantially U-shaped bale having a bight portion and parallel leg portions extending therefrom, each leg terminating in a free end and the free end of each of said legs of being pivotally mounted to said frame structure, said releasable retaining structure further including a plurality of longitudinally spaced flanges mounted on a bottom surface of said seat, each flange extending downwardly from said bottom surface and extending transversely with respect to said seat, the releasable retaining structure being constructed and arranged such that the bight portion of the bale can be pivoted to engage a selected flange to releasably retain said seat the selected seat position.

17. The exercise device as defined in claim 15 wherein said frame structure supports laterally spaced seat adjacent hand grips carried by said frame structure adjacent said seat in a position enabling a user seated on said seat and the adjacent rollers with said seat in said upwardly inclined position while facing away from said exercise support to reach down and grip said seat adjacent hand grips to hold the position while the user's legs are moved in the air.

18. The exercise device as claimed in claim 17 wherein said frame structure includes a pair of parallel, elongated longitudinally extending frame members having a plurality of longitudinally spaced, transversely extending shafts mounted therein with opposite outwardly extending portions, said frame members being constructed and arranged to arch upwardly and then downwardly from said seat towards said opposite longitudinal end of said frame structure and to cooperate with said plurality of shafts to rotatably mount said plurality of rollers in said arched array such that a central roller is rotatably mounted on a central portion of each shaft between said frame members and a pair of opposite side rollers are rotatably mounted on the respective opposite outwardly extending portions thereof and in abutting relation to the frame members such that when said user is being supported in a supine position on said rollers, the central rollers are positioned to receive and rollingly support a spine area of the user and the opposite side rollers are positioned to rollingly support respective sides of the back of the user.

19. The exercise device as defined in claim 18 wherein an opposite end shaft and a seat adjacent shaft of said plurality of shafts extend axially beyond the opposite side rollers thereon, said opposite end hand grips and said seat adjacent hand grips including cushioned members mounted on the outer extensions of said opposite end shaft and said seat shaft respectively.

20. The exercise device as defined in claim 1 wherein said frame structure supports laterally spaced intermediate hand grips carried by an intermediate portion of said frame structure in an upper back strengthening position enabling a user positioned with the user's back engaging said rollers, the user's head and shoulders on a floor pad extending from the opposite end of said frame structure and the user's legs extending upwardly in the air to conveniently reach down below the rollers supporting the user's back and grip the intermediate hand grips with both hands to allow the user to retain the user's head, shoulders and back in said upper back strengthening position while the user's legs are moved in the air.

21. The exercise device as claimed in claim 20 wherein said frame structure includes a pair of parallel, elongated longitudinally extending frame members having a plurality of longitudinally spaced, transversely extending shafts mounted therein with opposite outwardly extending portions, said frame members being constructed and arranged to arch upwardly and then downwardly from said seat towards said opposite longitudinal end of said frame structure and to cooperate with said plurality of shafts to rotatably mount said plurality of rollers in said arched array such that a central roller is rotatably mounted on a central portion of each shaft between said frame members and a pair of opposite side rollers are rotatably mounted on the respective opposite outwardly extending portions thereof and in abutting relation to the frame members such that when said user is being supported in a supine position on said rollers, the central rollers are positioned to receive and rollingly support a spine area of the user and the opposite side rollers are positioned to rollingly support respective sides of the back of the user.

22. The exercise device as defined in claim 20 wherein said intermediate hand grips comprise cushioned members mounted on opposite ends of an intermediate shaft carried by a support structure rigidly secured to said frame members and extending generally vertically downwardly from an intermediate portion thereof.

23. The exercise device as defined in claim 1 wherein said frame structure further includes rollable members mounted at said opposite longitudinal end of said frame structure, said rollable members being constructed and arranged such that a user can grasp said exercise support and pivot the one longitudinal end of said frame structure upwardly with respect to the horizontal surface about said rollable members and then push or pull on the exercise support to roll said frame structure in a desired direction and wherein said frame structure further includes hinge structure to provide folding movement of said frame structure between said operative position and a folded storage position in which said frame structure extends generally vertically with respect to said horizontal surface, said hinge structure being constructed and arranged such that when said frame structure is in the operative position thereof, the frame structure can be folded by raising said frame structure upwardly about said hinge structure and said exercise support and said arched array of rollers being constructed and arranged such that said exercise support and a plurality of rollers at the opposite longitudinal end of said arched array support said frame structure on said horizontal surface in the folded storage position and hold the rollable members above said horizontal surface.

24. The exercise device as defined in claim 23 wherein said exercise support is in releasably locked engagement with said frame structure to allow said exercise support to be released from locking engagement therewith and moved with respect thereto in a generally longitudinal direction and then relocked to accommodate the arm length and leg length of the user.

25. The exercise device as claimed in claim 24 wherein said frame structure includes a pair of parallel, elongated longitudinally extending frame members having a plurality of longitudinally spaced, transversely extending shafts mounted therein with opposite outwardly extending portions, said frame members being constructed and arranged to arch upwardly and then downwardly from said seat towards said opposite longitudinal end of said frame structure and to cooperate with said plurality of shafts to rotatably mount said plurality of rollers in said arched array such that a central roller is rotatably mounted on a central portion of each shaft between said frame members and a pair of opposite side rollers are rotatably mounted on the respective opposite outwardly extending portions thereof and in abutting relation to the frame members such that when said user is being supported in a supine position on said rollers, the central rollers are positioned to receive and rollingly support a spine area of the user and the opposite side rollers are positioned to rollingly support respective sides of the back of the user.

26. The exercise device as defined in claim 25 wherein said frame structure further includes hinge structure to provide folding movement of said frame structure between said operative position and a folded storage position in which said frame structure extends generally vertically with respect to said horizontal surface, said hinge structure being constructed and arranged such that when said frame structure is in the operative position thereof, the frame structure can be folded by raising said frame structure upwardly about said hinge structure and said exercise support and said arched array of rollers being constructed and arranged such that said exercise support and a plurality of rollers at the opposite longitudinal end of said arched array support said frame structure on said horizontal surface in the folded storage position and hold the rollable members above said horizontal surface.

27. The exercise device as defined in claim 1 wherein said frame structure further includes hinge structure to provide folding movement of said frame structure between said operative position and a folded storage position in which said frame structure extends generally vertically with respect to said horizontal surface, said hinge structure being constructed and arranged such that when said frame structure is in the operative position thereof, the frame structure can be folded by raising said frame structure upwardly about said hinge structure and said exercise support and said arched array of rollers being constructed and arranged such that said exercise support and a plurality of rollers at the opposite longitudinal end of said arched array support said frame structure on said horizontal surface in the folded storage position and hold the rollable members above said horizontal surface.

28. The exercise device as defined in claim 27 wherein said frame structure further includes rollable members mounted at said opposite longitudinal end of said frame structure, said rollable members being constructed and arranged such that a user can grasp said exercise support and pivot the one longitudinal end of said frame structure upwardly with respect to the horizontal surface about said rollable members and then push or pull on the exercise support to roll said frame structure in a desired direction and wherein said frame structure further includes hinge structure to provide folding movement of said frame structure between said operative position and a folded storage position in which said frame structure extends generally vertically with respect to said horizontal surface, said hinge structure being constructed and arranged such that when said frame structure is in the operative position thereof, the frame structure can be folded by raising said frame structure upwardly about said hinge structure and said exercise support and said arched array of rollers being constructed and arranged such that said exercise support and a plurality of rollers at the opposite longitudinal end of said arched array support said frame structure on said horizontal surface in the folded storage position and hold the rollable members above said horizontal surface.

29. The exercise device as claimed in claim 28 wherein said frame structure includes a pair of parallel, elongated longitudinally extending frame members having a plurality of longitudinally spaced, transversely extending shafts mounted therein with opposite outwardly extending portions, said frame members being constructed and arranged to arch upwardly and then downwardly from said seat towards said opposite longitudinal end of said frame structure and to cooperate with said plurality of shafts to rotatably mount said plurality of rollers in said arched array such that a central roller is rotatably mounted on a central portion of each shaft between said frame members and a pair of opposite side rollers are rotatably mounted on the respective opposite outwardly extending portions thereof and in abutting relation to the frame members such that when said user is being supported in a supine position on said rollers, the central rollers are positioned to receive and rollingly support a spine area of the user and the opposite side rollers are positioned to rollingly support respective sides of the back of the user.

30. The exercise device as defined in claim 1 wherein said exercise support is in releasably locked engagement with said frame structure to allow said exercise support to be released from locking engagement therewith and moved with respect thereto in a generally longitudinal direction and then relocked to accommodate the arm length and leg length of the user.

31. The exercise device as claimed in claim 1 wherein said frame structure includes a pair of parallel, elongated longitudinally extending frame members having a plurality of longitudinally spaced, transversely extending shafts mounted therein with opposite outwardly extending portions, said frame members being constructed and arranged to arch upwardly and then downwardly from said seat towards said opposite longitudinal end of said frame structure and to cooperate with said plurality of shafts to rotatably mount said plurality of rollers in said arched array such that a central roller is rotatably mounted on a central portion of each shaft between said frame members and a pair of opposite side rollers are rotatably mounted on the respective opposite outwardly extending portions thereof and in abutting relation to the frame members such that when said user is being supported in a supine position on said rollers, the central rollers are positioned to receive and rollingly support a spine area of the user and the opposite side rollers are positioned to rollingly support respective sides of the back of the user.

32. The exercise device as defined in claim 31 wherein said frame structure includes:

a longitudinally extending tubular frame member rigidly fixed with respect to seat adjacent ends of said frame members and extending at a downwardly inclined angle therefrom and then upwardly to provide an upwardly angled tubular end on said one longitudinal end of said frame structure, said exercise support being a T-shaped member having a stem and a cross support element, a free end of the stem being telescopically mounted within said upwardly angled tubular end of said tubular frame member to provide movement of the cross support element in said generally longitudinal direction, releasable locking structure operatively associated with said tubular end of said frame structure and said stem of said T-shaped member to releasably lock said exercise support with respect to the tubular frame member, and a surface engaging member rigidly secured to an intermediate portion of said tubular frame member.

33. The exercise device as defined in claim 32 further including rollable members mounted at said opposite longitudinal end of said frame structure, said the rollable members being constructed and arranged to allow a user to grasp said exercise support and pivot the one longitudinal end of said frame structure upwardly with respect to the horizontal surface about said rollable members and then push or pull on the exercise support to roll said frame structure in a desired direction.

34. The exercise device as defined in claim 33 wherein said frame structure further includes hinge structure to provide folding movement of said frame structure between said operative position and a folded storage position in which said frame structure extends generally vertically with respect to said horizontal surface, said hinge structure being constructed and arranged such that when said frame structure is in the operative position thereof, the frame structure can be folded by raising said frame structure upwardly about said hinge structure and said exercise support and said arched array of rollers being constructed and arranged such that said exercise support and a plurality of rollers at the opposite longitudinal end of said arched array support said frame structure on said horizontal surface in the folded storage position and hold the rollable members above said horizontal surface.

35. The exercise device as defined in claim 1 further including a pillow constructed and arranged to be a removably mounted on at least one roller adjacent the opposite end of said frame structure in a position over said one roller to support a user's head when the user's back is supported on the rollers arrayed from said at least one roller towards said seat.

* * * * *

UNITED STATES PATENT AND TRADEMARK OFFICE

CERTIFICATE OF CORRECTION

PATENT NO. : 6,231,489 B1
DATED : May 15, 2001
INVENTOR(S) : McBride et al.

It is certified that error appears in the above-identified patent and that said Letters Patent is hereby corrected as shown below:

Title page,
Item "[73] Assignee:", please change "Stamina Products, Inc., Springfield, PA" to -- Stamina Products, Inc., Springfield, MO --

Signed and Sealed this

Second Day of April, 2002

*Attest:*

*Attesting Officer*

JAMES E. ROGAN
*Director of the United States Patent and Trademark Office*